US012523104B2

(12) United States Patent
Zhang et al.

(10) Patent No.: US 12,523,104 B2
(45) Date of Patent: Jan. 13, 2026

(54) CUSTOMIZED CENTRALIZING HOUSING FOR DOWNHOLE TOOL

(71) Applicant: Halliburton Energy Services, Inc., Houston, TX (US)

(72) Inventors: Lizheng Zhang, Humble, TX (US); Yu-Hsing Charles Kuo, Sugar Land, TX (US); Paravastu Badrinarayanan, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 104 days.

(21) Appl. No.: 18/527,790

(22) Filed: Dec. 4, 2023

(65) Prior Publication Data

US 2025/0179882 A1 Jun. 5, 2025

(51) Int. Cl.
*E21B 17/10* (2006.01)

(52) U.S. Cl.
CPC ..... *E21B 17/105* (2013.01); *E21B 17/1078* (2013.01)

(58) Field of Classification Search
CPC ..... E21B 17/105; E21B 17/1078
See application file for complete search history.

(56) References Cited

U.S. PATENT DOCUMENTS

| | | | |
|---|---|---|---|
| 3,323,327 A | 6/1967 | Leathers et al. | |
| 4,497,384 A | 2/1985 | Hart | |
| 4,571,215 A | 2/1986 | Hansen | |
| 4,938,299 A | 7/1990 | Jelsma | |
| 5,247,990 A | 9/1993 | Sudol et al. | |
| 6,429,653 B1 | 8/2002 | Kruspe et al. | |
| 7,048,064 B1 | 5/2006 | Smith | |
| 2010/0276138 A1 | 11/2010 | Wittman et al. | |
| 2014/0312752 A1* | 10/2014 | Durisotti | H05K 5/0217 29/428 |
| 2022/0145708 A1 | 5/2022 | Marr et al. | |

FOREIGN PATENT DOCUMENTS

WO 2013082376 A1 6/2013

OTHER PUBLICATIONS

International Patent Application No. PCT/US2023/082275, International Search Report and Written Opinion mailed Aug. 29, 2024, 10 pages.

* cited by examiner

*Primary Examiner* — Nicole Coy
*Assistant Examiner* — Nicholas D Wlodarski
(74) *Attorney, Agent, or Firm* — Kilpatrick Townsend & Stockton LLP

(57) ABSTRACT

A system can include an outer housing, a customized housing, and centralizing elements. The outer housing can define an inner diameter. The customized housing can be positioned approximately concentrically within the outer housing. The customized housing can include slots arranged spaced-apart around an outer diameter of the customized housing. Each slot of the plurality of slots can be sized to receive one or more centralizing elements. The centralizing elements can include the one or more centralizing elements. Each centralizing element can be sized to be positioned in a corresponding slot of the slots and to contact the inner diameter of the outer housing while located in the corresponding slot.

20 Claims, 4 Drawing Sheets

CUSTOMIZED CENTRALIZING HOUSING FOR DOWNHOLE TOOL

TECHNICAL FIELD

The present disclosure relates generally to wellbore operations and, more particularly (although not necessarily exclusively), to a customized centralizing housing that can be used to provide centering to a tool that can be positioned in a wellbore.

BACKGROUND

Wellbore operations may include various equipment, components, methods, or techniques to form a wellbore, to complete a wellbore, to displace and release produced material, such as hydrocarbons, water, and the like, using a wellbore or flowline, and the like. In some examples, the wellbore operations can include a wellbore drilling operation that can form the wellbore. The wellbore drilling operation can include one or more tools that can be used to form the wellbore. The one or more tools may include electronics or other suitable and sensitive equipment that may experience damage in response to shock or other forces during the wellbore drilling operation. Centering the one or more tools can mitigate or prevent damage to the one or more tools, but centering the one or more tools can be difficult.

DETAILED DESCRIPTION

Figure 1:
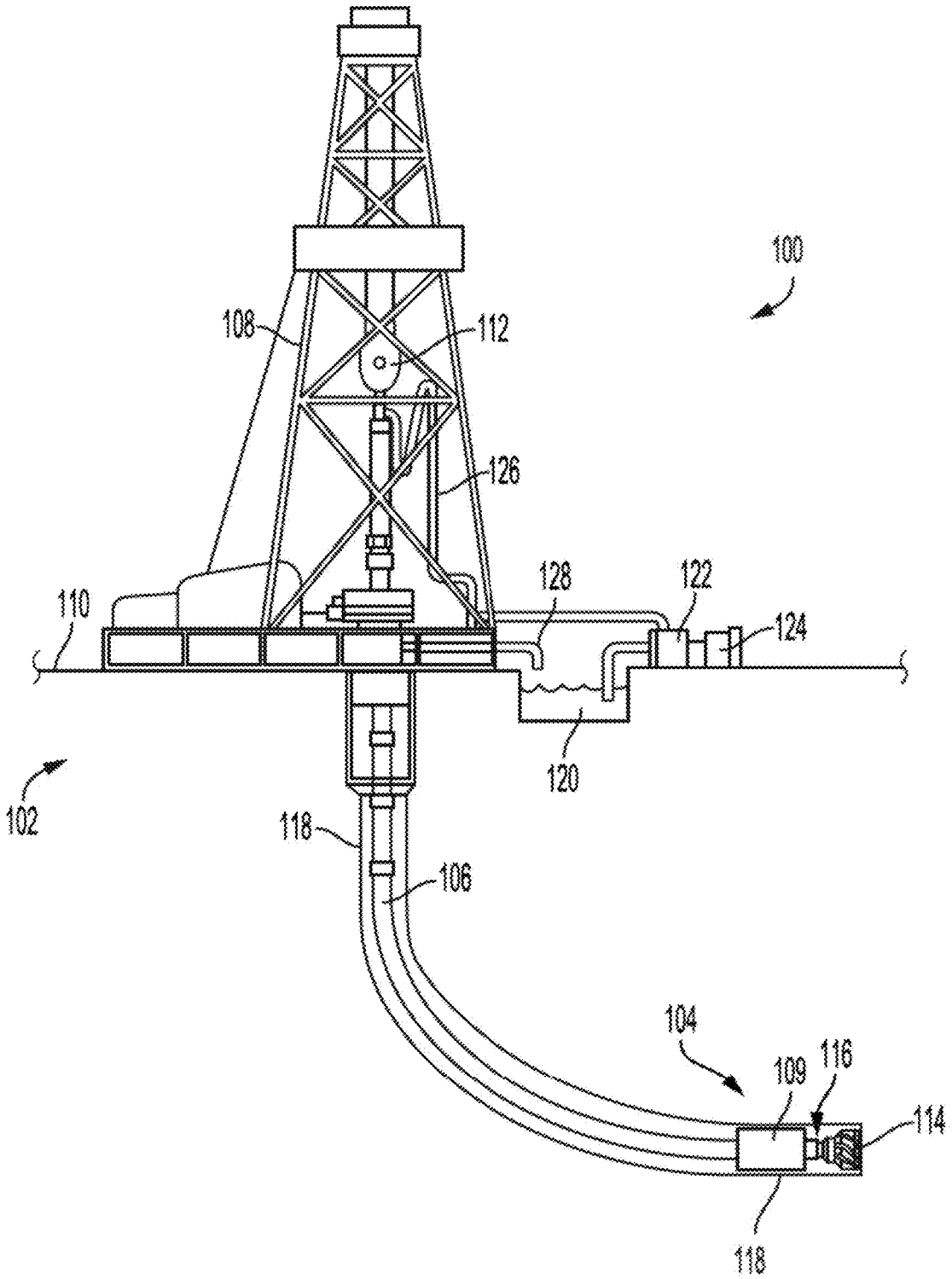
FIG. 1 is a diagram of a well system that can use a downhole tool with a customized centralizing housing according to one example of the present disclosure.

Certain aspects and examples of the present disclosure relate to a customized centralizing housing for a wellbore tool. The wellbore tool can be or include a wellbore drilling tool, a wellbore completion tool, a wellbore stimulation tool, or any other suitable wellbore tool that can be positioned in a wellbore and that may include sensitive or fragile equipment. The sensitive or fragile equipment may be or include electronic equipment or other equipment that can measure or record data with respect to a wellbore operation involving the wellbore tool. The customized centralizing housing can be positioned in the wellbore tool to center the sensitive or fragile equipment or to otherwise center components included in the wellbore tool. For example, the customized centralizing housing can be positioned around the sensitive or fragile equipment and may contact an inner diameter of a collar or outer housing of the wellbore tool. By centering the fragile or sensitive equipment, the customized centralizing housing can protect the fragile or sensitive equipment and can mitigate or prevent damage to the fragile or sensitive equipment. The customized centralizing housing can include one or more slots on an external surface that can receive the centralizing elements. The centralizing elements can be easily replaceable elements that can contact the inner diameter of the collar to keep the customized centralizing housing, and the sensitive or fragile equipment, centered in the wellbore tool.

Sonde centralization can be used to provide lateral support to position electronics or other sensitive equipment relative to a surrounding environment. For example, sonde in a measure-while-drilling (MWD) system or a rotary steerable system (RSS) can be supported to mitigate or eliminate shock or vibration and can be centered to at least approximately coincide with a rotational axis of a drill string. Additionally or alternatively, wireline logging tools, or other electronics, can be centered with respect to a casing or with respect to a wellbore to optimize a depth of investigation or the like.

A sonde housing can include a tubular with an approximately circular outer diameter and a housing, which can include a centralizer, that can be positioned within the tubular. The centralizer can be mechanically connected to the housing. In some examples, set screws, clamps, and the like can be used to mechanically connect the centralizer to the housing. But, when exposed to threshold levels of shock, vibration, or the like, the set screws, the clamps, and the like can loosen or can otherwise fail to provide proper centralization to electronics or other sensitive equipment. Additionally or alternatively, the centralizer may wear out excessively fast when using the set screws, the clamps, and the like. In some examples, and in response to the set screws, the clamps, and the like loosening, the centralizer may be displaced to an undesirable location that may inhibit proper measurements made by the electronics. Additionally or alternatively, the housing may include limited number of centralizers due to the cost, the time, and the like involved with machining the centralizing.

Sonde-based MWD or RSS tools can have electronics, sensors, and the like positioned inside a sonde housing, which can be placed inside a drill collar. Drilling mud can pass through a bore area defined between the outer diameter of the sonde housing and an inner diameter of the collar. Housings can be manufactured by machining operation, or turning, and can have approximately a circular outer diameter. For volume production of housings with standardized outer diameters and inner diameters, flow-forming or metal extrusion can be a more economical way to form housings. Accordingly, housing cross-sections can be customized to be any shape that may be suitable for flow-forming and maintaining pressure ratings.

A customized centralizing housing can be used to improve a performance of centralizing electronics or other sensitive equipment in a downhole tool. The customized centralizing housing can include a customized cross-section that may be or include a modified circle. For example, the customized cross-section can be generally circular and may include a set of slots arranged about an outer diameter of the customized centralizing housing. Each slot of the set of slots may be sized to received a different centralizing element of a set of centralizing elements, which may include one or more discrete centralizing elements or one or more continuous centralizing elements. In some examples, the customized centralizing housing can be formed via flow-forming, extrusion, or the like.

In some examples, the customized centralizing housing can include various improvements compared to other housings such as pressure housings. The customized centralizing housing can include integrated features, such as the set of slots, arranged on an outer diameter of the customized centralizing housing along the length of the customized centralizing housing. The centralizing elements can be positioned, for example by simply sliding, in the integrated features, and the centralizing elements can extend continuously along the length of the customized centralizing housing. Additionally or alternatively, the centralizing elements can be easily removed, replaced, repaired, or the like.

A customized housing cross-section profile can include features to receive centralizing elements. In some examples, the housing can have a set of dovetail-shaped channels on the outer diameter to retain the centralizing elements. In other examples, the channels may be t-shaped or otherwise suitably shaped to receive or retain the centralizing elements. The centralizing elements can be or include rubber, plastic, metal encapsulated with rubber, etc. In some examples, the centralizing elements can be or include extruded plastic, or molded elastomer, cut to different lengths to install. The centralizing elements can have different heights to accommodate different tool sizes with the same or similar sonde. Since the centralizing element can be coupled to the sonde and the collar, the centralizing element can provide better support than set-screw-based blade centralizers or other centralizers. The centralizing elements can cover some or all of the customized housing length and may provide continuous lateral support.

The customizable housing can include end caps that can be used to receive or retain, for example axially, the centralizing elements. The end caps can be or include metallic or plastic materials and may include anti-erosion coatings, such as a high-velocity oxygen fuel (HVOF) coatings, which can reduce erosive wear of the centralizing elements. The end cap can be secured to the housing by the corresponding channel and one or more retaining pins. In some examples, the one or more retaining pins can be or include a spiral type of retaining pin.

These illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a diagram of a well system 100 that can use a downhole tool with a customized centralizing housing according to one example of the present disclosure. The well system 100 can include a wellbore 118 that can be used to extract hydrocarbons from a subterranean formation 102. The wellbore 118 can be drilled or otherwise formed using the well system 100. For example, the well system 100 may drive a bottom hole assembly (BHA) 104 positioned or otherwise arranged at the bottom of a drill-string 106 extended into the subterranean formation 102 from a derrick 108 arranged at the surface 110. The derrick 108 can include a kelly 112 used to lower and raise the drill-string 106.

The BHA 104 may include a drill bit 114, a drilling system 109, such as a measure-while-drilling system a rotary steerable system, or the like, other suitable components, or a combination thereof. The drill bit 114 can be operatively coupled to a tool string 116, and the drill bit 114 may be moved axially within a drilled wellbore 118 and can be attached to the drill-string 106. During operation, the drill bit 114 can penetrate the subterranean formation 102 to create the wellbore 118. The BHA 104 can control the drill bit 114 as the drill bit 114 advances into the subterranean formation 102. For example, the drilling system 109 can control a direction of drilling, can make measurements while drilling, or the like.

Fluid or "mud" from a mud tank 120 may be pumped downhole using a mud pump 122 that can be powered by an adjacent power source, such as a prime mover or motor 124. The mud may be pumped from the mud tank 120, through a stand pipe 126, which can feed the mud into the drill-string 106, the drilling system 109, or other suitable components of the well system 100 and can convey the mud to the drill bit 114. The mud can exit one or more nozzles (not shown) arranged in the drill bit 114 and can thereby cool the drill bit 114. In some examples, the mud can be directed (e.g., as pressurized mud) into the drilling system 109 for adjusting a direction of the drill bit 114. After exiting the drill bit 114 or other suitable component, the mud can circulate back to the surface 110 via the annulus defined between the wellbore 118 and the drill-string 106. Cuttings and mud mixture that can be passed through a flow line 128 can be processed such that a cleaned mud is returned down hole through the stand pipe 126.

The drilling system 109 can include a wellbore tool that can include one or more suitable components. For example, the wellbore tool can include an outer housing, a customized centralizing housing, a set of centralizing elements, and the like. The outer housing can define an inner diameter that can be in contact with the set of centralizing elements. The set of centralizing elements can be positioned in slots or other customized features of the customized centralizing housing. In some examples, the set of centralizing elements can be retaining in the slots or the other customized features via an end cap, a retaining pin, other suitable retaining elements, or any combination thereof. The drilling system 109 can include other suitable components.

Figure 2:
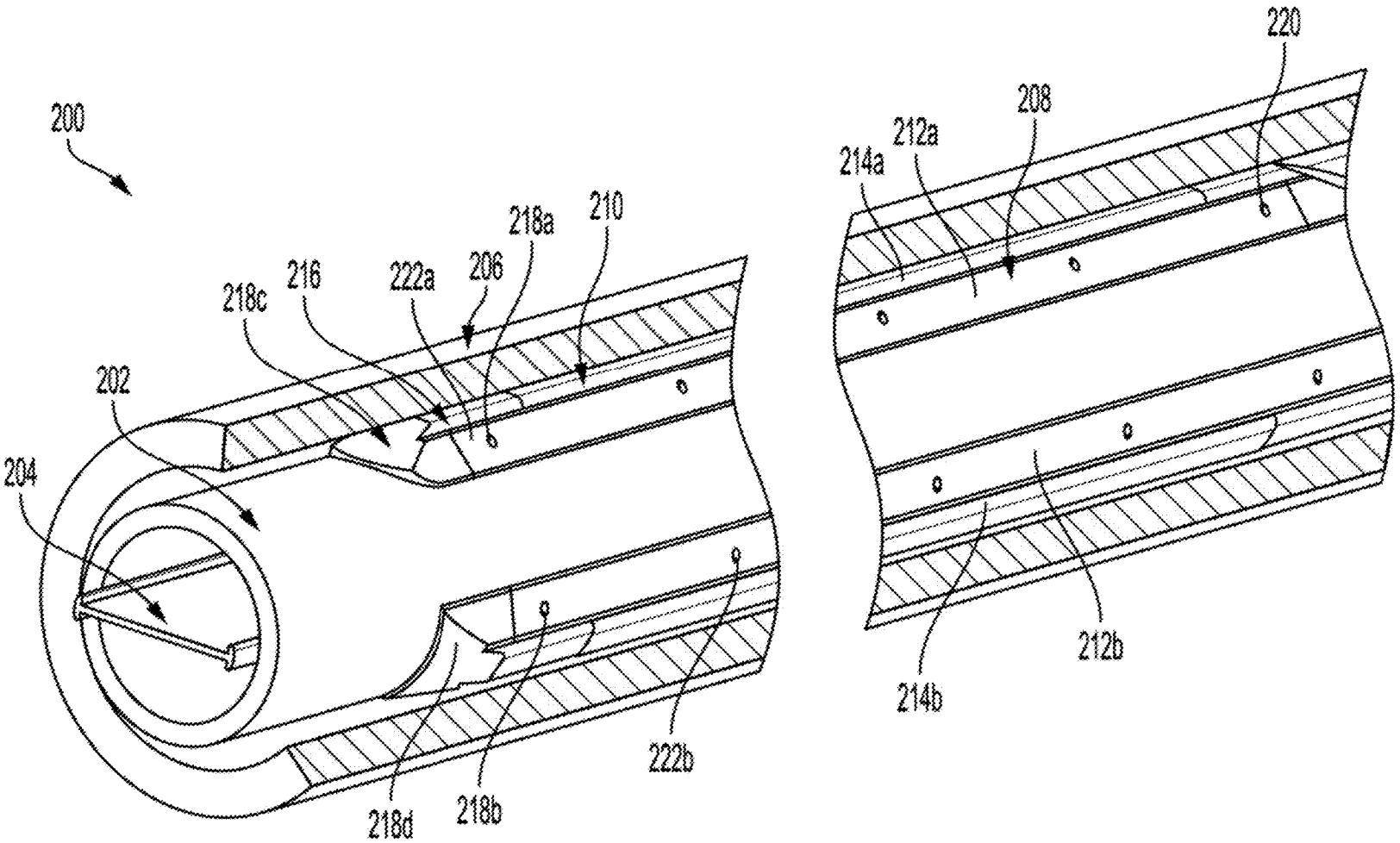
FIG. 2 is a perspective view of a downhole tool with a customized centralizing housing according to one example of the present disclosure.

FIG. 2 is a perspective view of a downhole tool 200 with a customized centralizing housing 202 according to one example of the present disclosure. In some examples, the downhole tool 200 may be similar or identical to the drilling system 109 as illustrated and described with respect to FIG. 1. In other examples, the downhole tool 200 may be used with respect to other wellbore operations, for example not associated with a wellbore drilling operation. As illustrated in FIG. 2, the downhole tool 200 can include the customized centralizing housing 202, a set of electronics 204, an outer housing 206, a set of slots 208, and a set of centralizing elements 210, though the downhole tool 200 can include any suitable additional or alternative features. The customized centralizing housing 202 can be positioned approximately concentrically within the outer housing 206 and can include the set of slots 208 and the set of centralizing elements 210. Additionally or alternatively, the set of electronics 204 may be positioned within the customized centralizing housing 202. The set of electronics 204 may be at least approximately centered by the customized centralizing housing 202, for example via the set of slots 208 and the set of centralizing elements 210.

In some examples, the set of slots 208 may include one or more slots. As illustrated in FIG. 2, the set of slots 208 may include at least a first slot 212*a* and a second slot 212*b*, though any other suitable number (e.g., one or more than two) of slots is possible to be included in the set of slots 208. Additionally or alternatively, the set of centralizing elements 210 may include one or more centralizing elements. As illustrated in FIG. 2, the set of centralizing elements 210 may include at least a first centralizing element 214*a* and a second centralizing element 214*b*, though any other suitable number (e.g., one or more than two) of centralizing elements is possible to be included in the set of centralizing elements 210. Each centralizing element of the set of centralizing elements 210, or any subset thereof, may include one or more discrete centralizing elements. For example, the first centralizing element 214*a* can include one discrete centralizing element, two discrete centralizing elements, three discrete centralizing elements, or more than three discrete centralizing elements. In other examples, each centralizing element of the set of centralizing elements 210, or any subset thereof, may be a continuous centralizing element that can extend along a length of the outer housing 206. Additionally or alternatively, each centralizing element of the set of centralizing elements 210, or any subset thereof, may be or include a easily replaceable material, or a material designed to experience wear, such as plastic, rubber, or the like.

In some examples, each centralizing element of the set of centralizing elements 210, or any subset thereof, can be retained in a corresponding slot of the set of slots 208 via a retaining element of a set of retaining elements 216. As illustrated in FIG. 2, the set of retaining elements 216 can include a first retaining element 218*a*, a second retaining element 218*b*, a third retaining element 218*c*, and a fourth retaining element 218*d*, though any other suitable number (e.g., less than four or more than four) of retaining elements is possible to include in the set of retaining elements 216. The first retaining element 218*a* and the second retaining element 218*b* may each be or include a retaining pin, and the third retaining element 218*c* and the fourth retaining element 218*d* may each be or include an end cap. The set of retaining elements 216, or any subset thereof, can be positioned in a set of retaining holes 220 such as a first retaining hole 222*a* and a second retaining hole 222*b*, etc. In some examples, the set of retaining elements 216 can be used to physically retain the set of centralizing elements 210 in the set of slots 208. For example, and in response to positioning a particular centralizing element in a particular slot, one or more retaining elements of the set of retaining elements 216 can be positioned in one or more retaining holes of the set of retaining holes 220 to physically retain, such as by contacting, the particular centralizing element in the particular slot.

Figure 3:
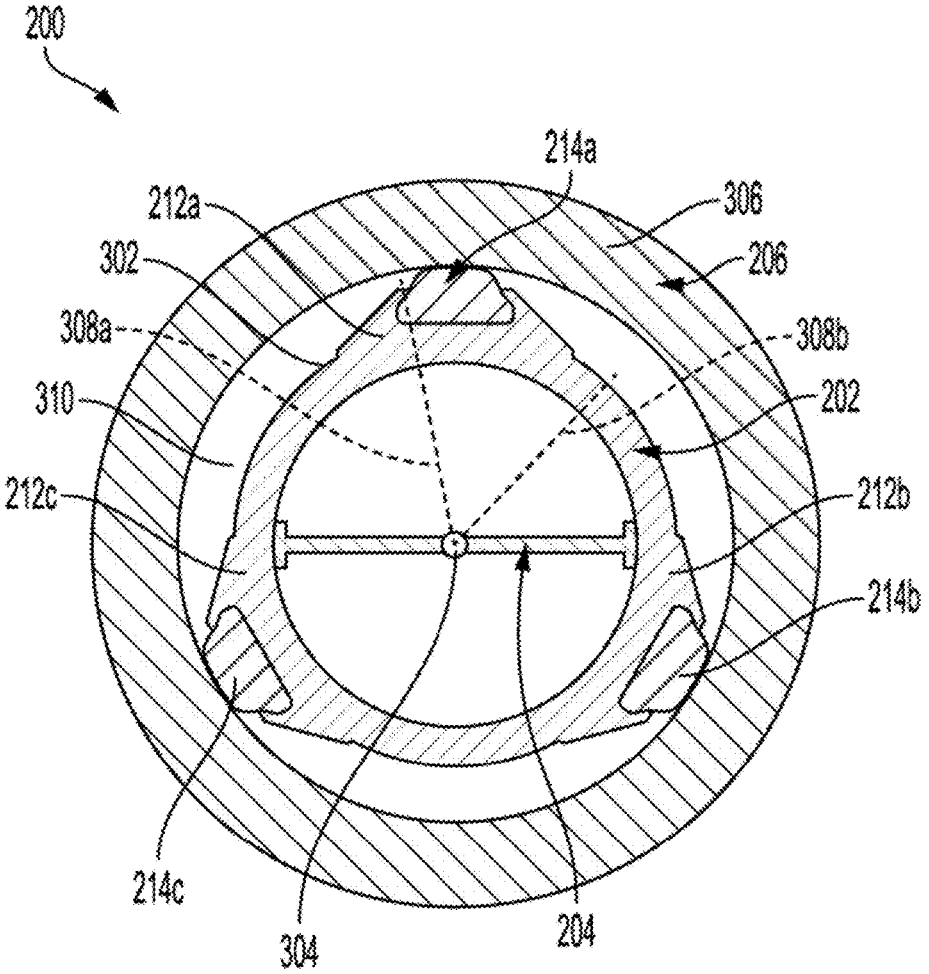
FIG. 3 is a sectional view of a downhole tool with a customized centralizing housing according to one example of the present disclosure.

FIG. 3 is a sectional view of a downhole tool 200 with a customized centralizing housing 202 according to one example of the present disclosure. As illustrated in FIG. 3, the downhole tool 200 can include the customized centralizing housing 202, the set of electronics 204, and the outer housing 206, though the downhole tool 200 can include any suitable additional or alternative features. Additionally or alternatively, the downhole tool can include the first slot 212*a*, the second slot 212*b*, a third slot 212*c*, the first centralizing element 214*a*, the second centralizing element 214*b*, and a third centralizing element 214*c*. While FIG. 3 illustrates the customized centralizing housing 202 as include three slots and three centralizing elements, any other suitable number (e.g., less than three or more than three) of slots or of centralizing elements is possible to include in the customized centralizing housing 202.

In some examples, the set of slots included in the customized centralizing housing 202 may be arrange spaced apart around an outer diameter 302 of the customized centralizing housing 202. For example, the first slot 212*a*, the second slot 212*b*, and the third slot 212*c* may be approximately equally spaced around a central axis 304 of the customized centralizing housing 202. Equally spaced around the central axis 304 may involve each slot of the first slot 212*a*, the second slot 212*b*, and the third slot 212*c* being offset from an adjacent slot by approximately 120 degrees, though other suitable offsets are possible for the slots. Additionally or alternatively, the centralizing elements included in the customized centralizing housing 202 can be spaced apart around the central axis 304 and on the outer diameter 302. Each centralizing element, such as the first centralizing element 214*a*, the second centralizing element 214*b*, and the third centralizing element 214*c*, can be positioned in a corresponding slot. For example, the first centralizing element 214*a* can be positioned in the first slot 212*a*, the second centralizing element 214*b* can be positioned in the second slot 212*b*, and the third centralizing element 214*c* can be positioned in the third slot 212*c*, though any suitable permutation thereof may be possible.

In some examples, the centralizing elements can be positioned in the slots to provide centering for the one or more electronics 204. As illustrated in FIG. 3, the first centralizing element 214*a*, the second centralizing element 214*b*, and the third centralizing element 214*c* can be positioned in a corresponding slot to each contact an inner diameter 306 of the outer housing 206. For example, each slot included in the customized centralizing housing 202 can have a first radius 308*a* from the central axis 304 that may be larger than a second radius 308*b* associated with an outer diameter of the customized centralizing housing 202. The centralizing elements can be positioned in corresponding slots, and at least a top portion of each of the centralizing elements can be exposed to contact the inner diameter 306 of the outer housing 206. In some examples, the difference between the first radius 308*a* and the second radius 308*b* can cause a flow path 310 to be formed in the downhole tool 200. The flow path 310 can allow fluid, such as drilling fluid, mud, cuttings fluid, or other suitable wellbore fluid, to flow freely along the length of the downhole tool 200 without inhibiting a function of the downhole tool 200.

As illustrated in FIG. 3, the customized centralizing housing 202 can have a cross-sectional shape that approximately represents a modified circle. For example, the cross-sectional shape can be or include a circle with three slots arranged equally around an outer diameter of the customized centralizing housing 202 and protruding outward. In other examples, the cross-sectional shape can be or include any other suitable, general shapes such as approximately a modified triangle, approximately a modified square or rectangle, approximately a modified hexagon, irregular shapes, or any other suitable shapes.

Figure 4:
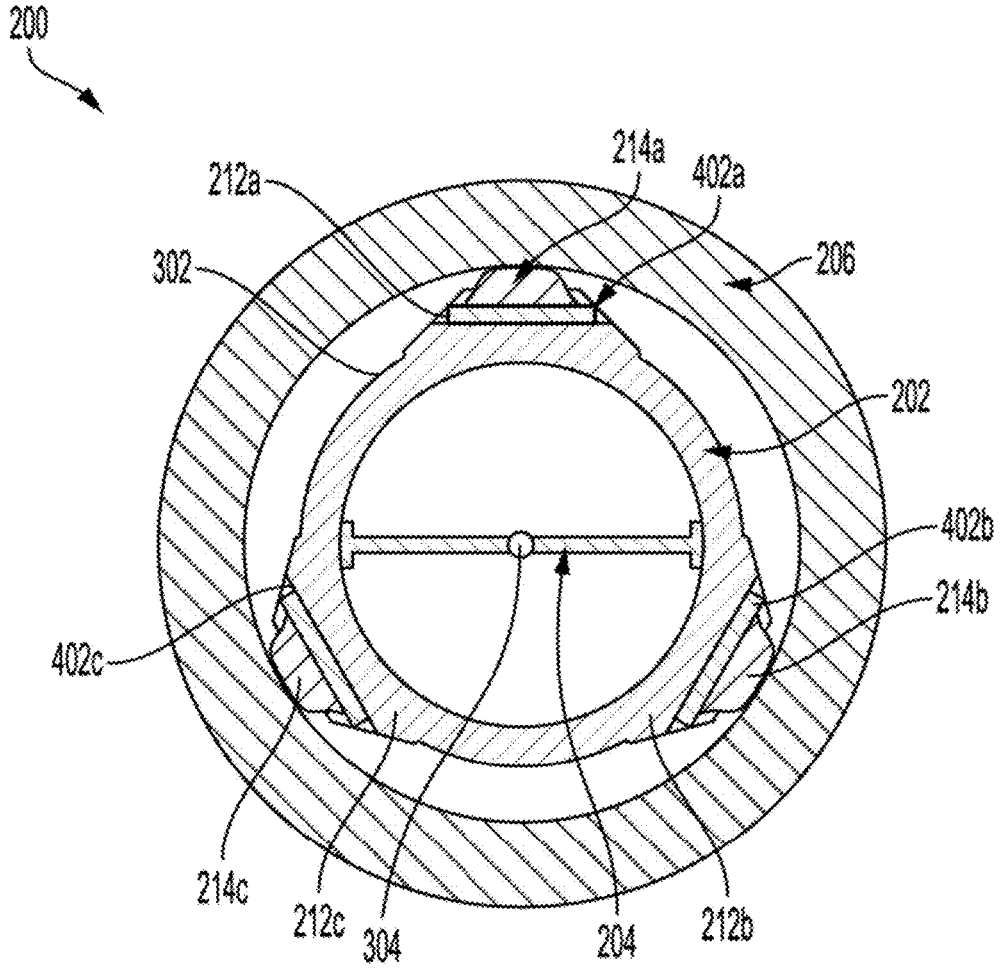
FIG. 4 is a sectional view of a downhole tool with a customized centralizing housing that includes a retaining element according to one example of the present disclosure.

FIG. 4 is a sectional view of a downhole tool 200 with a customized centralizing housing 202 that includes a retaining element 402 according to one example of the present disclosure. As illustrated in FIG. 4, the downhole tool 200 can include customized centralizing housing 202, the set of electronics 204, and the outer housing 206, though the downhole tool 200 can include any suitable additional or alternative features. Additionally or alternatively, the downhole tool can include the first slot 212*a*, the second slot 212*b*, the third slot 212*c*, the first centralizing element 214*a*, the second centralizing element 214*b*, and the third centralizing element 214*c*. While FIG. 4 illustrates the customized centralizing housing 202 as include three slots and three centralizing elements, any other suitable number (e.g., less than three or more than three) of slots or of centralizing elements is possible to include in the customized centralizing housing 202.

In some examples, the set of slots included in the customized centralizing housing 202 may be arrange spaced apart around the outer diameter 302 of the customized centralizing housing 202. For example, the first slot 212*a*, the second slot 212*b*, and the third slot 212*c* may be approximately equally spaced around the central axis 304.

Additionally or alternatively, the centralizing elements included in the customized centralizing housing 202 can be spaced apart around the central axis 304 and on the outer diameter 302.

Each centralizing element, such as the first centralizing element 214*a*, the second centralizing element 214*b*, and the third centralizing element 214*c*, can be positioned in a corresponding slot. For example, the first centralizing element 214*a* can be positioned in the first slot 212*a*, the second centralizing element 214*b* can be positioned in the second slot 212*b*, and the third centralizing element 214*c* can be positioned in the third slot 212*c*, though any suitable permutation thereof may be possible. In some examples, the centralizing elements may be retained in corresponding slots using at least one retaining element. As illustrated in FIG. 4, the first centralizing element 214*a* can be retained in the first slot 212*a* using a first retaining element 402*a*, the second centralizing element 214*b* can be retained in the second slot 212*b* using a second retaining element 402*b*, and the third centralizing element 214*c* can be retained in the third slot 212*c* using a third retaining element 402*c*, etc. The first retaining element 402*a*, the second retaining element 402*b*, the third retaining element 402*c*, or any combination thereof may be or include a retaining pin, an end cap, or the like. Additionally or alternatively, the first retaining element 402*a*, the second retaining element 402*b*, the third retaining element 402*c*, or any combination thereof may be a set of retaining elements that includes more than one retaining element, for example per corresponding slot.

In some aspects, systems and customized centralizing housings for centralizing a wellbore tool are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: an outer housing of a wellbore tool positionable in a wellbore, the outer housing defining an inner diameter; a customized housing positionable approximately concentrically within the outer housing, the customized housing comprising a plurality of slots arranged spaced-apart around an outer diameter of the customized housing, each slot of the plurality of slots sized to receive one or more centralizing elements; and a plurality of centralizing elements that includes the one or more centralizing elements, each centralizing element of the plurality of centralizing elements sized to be positioned in a corresponding slot of the plurality of slots and to contact the inner diameter of the outer housing while located in the corresponding slot.

Example 2 is the system of example 1, wherein each slot of the plurality of slots comprises one or more retaining holes, and wherein each retaining hole of the one or more retaining holes is sized to receive a retaining element for retaining a centralizing element in a corresponding slot of the plurality of slots.

Example 3 is the system of any of examples 1-2, further comprising a plurality of retaining elements, wherein each retaining element of the plurality of retaining elements is positionable in a corresponding retaining hole of the one or more retaining holes of a different slot of the plurality of slots to retain a corresponding centralizing element of the plurality of centralizing elements in the different slot.

Example 4 is the system of any of examples 1-3, wherein the plurality of retaining elements comprises one or more retaining pins, and wherein a first number of retaining pins included in the plurality of retaining elements is equal to a second number of slots included in the plurality of slots.

Example 5 is the system of example 1, further comprising one or more electronics positionable within the customized housing, wherein the one or more electronics are centerable with respect to a central axis of the outer housing by the customized housing and the plurality of centralizing elements.

Example 6 is the system of example 1, wherein the plurality of centralizing elements includes a first number of sets of centralizing elements that is equal to a second number of slots included in the plurality of slots, and wherein each set of centralizing elements of the sets of centralizing elements has a first length that is approximately equal to a second length of the outer housing.

Example 7 is the system of example 1, wherein the plurality of slots includes a first slot, a second slot, and a third slot, wherein the plurality of centralizing elements includes a first centralizing element, a second centralizing element, and a third centralizing element, and wherein the first centralizing element is located in the first slot, the second centralizing element is located in the second slot, and the third centralizing element is located in the third slot.

Example 8 is a customized centralizing housing comprising: an outer diameter positionable concentrically within an outer housing of a wellbore tool that is positionable in a wellbore; a plurality of slots arranged spaced-apart around the outer diameter, each slot of the plurality of slots sized to receive one or more centralizing elements; and a plurality of centralizing elements that includes the one or more centralizing elements, each centralizing element of the plurality of centralizing elements sized to be positioned in a corresponding slot of the plurality of slots and to contact an inner diameter of the outer housing while located in the corresponding slot.

Example 9 is the customized centralizing housing of example 8, wherein each slot of the plurality of slots comprises one or more retaining holes, and wherein each retaining hole of the one or more retaining holes is sized to receive a retaining element for retaining a centralizing element in a corresponding slot of the plurality of slots.

Example 10 is the customized centralizing housing of any of examples 8-9, further comprising a plurality of retaining elements, wherein each retaining element of the plurality of retaining elements is positionable in a corresponding retaining hole of the one or more retaining holes of a different slot of the plurality of slots to retain a corresponding centralizing element of the plurality of centralizing elements in the different slot.

Example 11 is the customized centralizing housing of any of examples 8-10, wherein the plurality of retaining elements comprises one or more retaining pins, and wherein a first number of retaining pins included in the plurality of retaining elements is equal to a second number of slots included in the plurality of slots.

Example 12 is the customized centralizing housing of example 8, further comprising one or more electronics positionable within the customized centralizing housing, wherein the one or more electronics are centerable with respect to a central axis of the outer housing by the customized centralizing housing.

Example 13 is the customized centralizing housing of example 8, wherein the plurality of centralizing elements includes a first number of sets of centralizing elements that is equal to a second number of slots included in the plurality of slots, and wherein each set of centralizing elements of the sets of centralizing elements has a first length that is approximately equal to a second length of the outer housing.

Example 14 is the customized centralizing housing of example 8, wherein the plurality of slots includes a first slot, a second slot, and a third slot, wherein the plurality of centralizing elements includes a first centralizing element, a second centralizing element, and a third centralizing element, and wherein the first centralizing element is located in the first slot, the second centralizing element is located in the second slot, and the third centralizing element is located in the third slot.

Example 15 is a system comprising: an outer housing of a wellbore tool positionable in a wellbore, the outer housing defining an inner diameter; and a customized centralizing housing positionable approximately concentrically within the outer housing, the customized centralizing housing comprising: a plurality of slots arranged spaced-apart around an outer diameter of the customized centralizing housing, each slot of the plurality of slots sized to receive one or more centralizing elements; and a plurality of centralizing elements that includes the one or more centralizing elements, each centralizing element of the plurality of centralizing elements sized to be positioned in a corresponding slot of the plurality of slots and to contact the inner diameter of the outer housing while located in the corresponding slot.

Example 16 is the system of example 15, wherein each slot of the plurality of slots comprises one or more retaining holes, and wherein each retaining hole of the one or more retaining holes is sized to receive a retaining element for retaining a centralizing element in a corresponding slot of the plurality of slots.

Example 17 is the system of any of examples 15-16, wherein the customized centralizing housing further comprises a plurality of retaining elements, wherein each retaining element of the plurality of retaining elements is positionable in a corresponding retaining hole of the one or more retaining holes of a different slot of the plurality of slots to retain a corresponding centralizing element of the plurality of centralizing elements in the different slot.

Example 18 is the system of any of examples 15-17, wherein the plurality of retaining elements comprises one or more retaining pins, and wherein a first number of retaining pins included in the plurality of retaining elements is equal to a second number of slots included in the plurality of slots.

Example 19 is the system of example 15, wherein the plurality of centralizing elements includes a first number of sets of centralizing elements that is equal to a second number of slots included in the plurality of slots, and wherein each set of centralizing elements of the sets of centralizing elements has a first length that is approximately equal to a second length of the outer housing.

Example 20 is the system of example 15, wherein the plurality of slots includes a first slot, a second slot, and a third slot, wherein the plurality of centralizing elements includes a first centralizing element, a second centralizing element, and a third centralizing element, and wherein the first centralizing element is located in the first slot, the second centralizing element is located in the second slot, and the third centralizing element is located in the third slot.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

an outer housing of a wellbore tool positionable in a wellbore, the outer housing defining an inner diameter;

a customized centralizing housing positionable approximately concentrically within the outer housing, the customized centralizing housing comprising a plurality of slots arranged spaced-apart around an outer diameter of the customized centralizing housing, each slot of the plurality of slots sized to receive a different centralizing element of a plurality of centralizing elements;

the plurality of centralizing elements, wherein each centralizing element of the plurality of centralizing elements is sized to be positioned in a corresponding slot of the plurality of slots and to contact the inner diameter of the outer housing while located in the corresponding slot; and a plurality of end caps, wherein each end cap of the plurality of end caps is located at an end of the corresponding slot of the plurality of slots to retain a corresponding centralizing element of the plurality of centralizing elements in the corresponding slot.

2. The system of claim 1, wherein each slot of the plurality of slots comprises one or more retaining holes, and wherein each retaining hole of the one or more retaining holes is sized to receive a retaining element for retaining a centralizing element in a corresponding slot of the plurality of slots.

3. The system of claim 2, further comprising a plurality of retaining elements, wherein each retaining element of the plurality of retaining elements is positionable in a corresponding retaining hole of the one or more retaining holes of a different slot of the plurality of slots to retain a corresponding centralizing element of the plurality of centralizing elements in the different slot.

4. The system of claim 3, wherein the plurality of retaining elements comprises one or more retaining pins, and wherein the plurality of retaining elements has the same number of retaining elements as the plurality of slots includes slots.

5. The system of claim 1, further comprising one or more electronics positionable within the customized centralizing housing, wherein the one or more electronics are centerable with respect to a central axis of the outer housing by the customized centralizing housing and the plurality of centralizing elements.

6. The system of claim 1, wherein the plurality of centralizing elements includes a first number centralizing elements that is equal to a second number of slots included in the plurality of slots, and wherein each centralizing element of the plurality of centralizing elements has a first length that is approximately equal to a second length of the outer housing.

7. The system of claim 1, wherein the plurality of slots includes a first slot, a second slot, and a third slot, wherein the plurality of centralizing elements includes a first centralizing element, a second centralizing element, and a third centralizing element, and wherein the first centralizing element is located in the first slot, the second centralizing element is located in the second slot, and the third centralizing element is located in the third slot.

8. A customized centralizing housing comprising:

an outer diameter positionable concentrically within an outer housing of a wellbore tool that is positionable in a wellbore;

a plurality of slots arranged spaced-apart around the outer diameter, each slot of the plurality of slots sized to receive a different centralizing element of a plurality of centralizing elements;

the plurality of centralizing elements, wherein each centralizing element of the plurality of centralizing elements is sized to be positioned in a corresponding slot of the plurality of slots and to contact an inner diameter of the outer housing while located in the corresponding slot; and a plurality of end caps, wherein each end cap of the plurality of end caps is located at an end of the corresponding slot of the plurality of slots to retain a corresponding centralizing element of the plurality of centralizing elements in the corresponding slot.

9. The customized centralizing housing of claim 8, wherein each slot of the plurality of slots comprises one or more retaining holes, and wherein each retaining hole of the one or more retaining holes is sized to receive a retaining element for retaining a centralizing element in a corresponding slot of the plurality of slots.

10. The customized centralizing housing of claim 9, further comprising a plurality of retaining elements, wherein each retaining element of the plurality of retaining elements is positionable in a corresponding retaining hole of the one or more retaining holes of a different slot of the plurality of slots to retain a corresponding centralizing element of the plurality of centralizing elements in the different slot.

11. The customized centralizing housing of claim 10, wherein the plurality of retaining elements comprises one or more retaining pins, and wherein the plurality of retaining elements has the same number of retaining elements as the plurality of slots includes slots.

12. The customized centralizing housing of claim 8, further comprising one or more electronics positionable within the customized centralizing housing, wherein the one or more electronics are centerable with respect to a central axis of the outer housing by the customized centralizing housing.

13. The customized centralizing housing of claim 8, wherein the plurality of centralizing elements includes a first number centralizing elements that is equal to a second number of slots included in the plurality of slots, and wherein each centralizing element of the plurality of centralizing elements has a first length that is approximately equal to a second length of the outer housing.

14. The customized centralizing housing of claim 8, wherein the plurality of slots includes a first slot, a second slot, and a third slot, wherein the plurality of centralizing elements includes a first centralizing element, a second centralizing element, and a third centralizing element, and wherein the first centralizing element is located in the first slot, the second centralizing element is located in the second slot, and the third centralizing element is located in the third slot.

15. A system comprising:

an outer housing of a wellbore tool positionable in a wellbore, the outer housing defining an inner diameter; and a customized centralizing housing positionable approximately concentrically within the outer housing, the customized centralizing housing comprising:

a plurality of slots arranged spaced-apart around an outer diameter of the customized centralizing housing, each slot of the plurality of slots sized to receive a different centralizing element of a plurality of centralizing elements;

the plurality of centralizing elements, wherein each centralizing element of the plurality of centralizing elements is sized to be positioned in a corresponding slot of the plurality of slots and to contact the inner diameter of the outer housing while located in the corresponding slot; and a plurality of end caps, wherein each end cap of the plurality of end caps is located at an end of the corresponding slot of the plurality of slots to retain a corresponding centralizing element of the plurality of centralizing elements in the corresponding slot.

16. The system of claim 15, wherein each slot of the plurality of slots comprises one or more retaining holes, and wherein each retaining hole of the one or more retaining holes is sized to receive a retaining element for retaining a centralizing element in a corresponding slot of the plurality of slots.

17. The system of claim 16, wherein the customized centralizing housing further comprises a plurality of retaining elements, wherein each retaining element of the plurality of retaining elements is positionable in a corresponding retaining hole of the one or more retaining holes of a different slot of the plurality of slots to retain a corresponding centralizing element of the plurality of centralizing elements in the different slot.

18. The system of claim 17, wherein the plurality of retaining elements comprises one or more retaining pins, and wherein the plurality of retaining elements has the same number of retaining elements as the plurality of slots includes slots.

19. The system of claim 15, wherein the plurality of centralizing elements includes a first number centralizing elements that is equal to a second number of slots included in the plurality of slots, and wherein each centralizing element of the plurality of centralizing elements has a first length that is approximately equal to a second length of the outer housing.

20. The system of claim 15, wherein the plurality of slots includes a first slot, a second slot, and a third slot, wherein the plurality of centralizing elements includes a first centralizing element, a second centralizing element, and a third centralizing element, and wherein the first centralizing element is located in the first slot, the second centralizing element is located in the second slot, and the third centralizing element is located in the third slot.

* * * * *